United States Patent [19]

Zuccato

[11] Patent Number: 4,936,821

[45] Date of Patent: Jun. 26, 1990

[54] CENTRIFUGAL SEPARATOR WITH ROTATING SEALS ON THE FIXED UPPER HEAD

[75] Inventor: Remo Zuccato, Chiuppano, Italy

[73] Assignee: Frau S.p.A., Vicenza, Italy

[21] Appl. No.: 226,382

[22] Filed: Jul. 29, 1988

Related U.S. Application Data

[63] Continuation-in-part of Ser. No. 116,524, Nov. 3, 1987, Pat. No. 4,810,240.

[30] Foreign Application Priority Data

Nov. 5, 1986 [IT] Italy ..... 85629 A/86
Aug. 3, 1987 [IT] Italy ..... 85588 A/87

[51] Int. Cl.[5] ..... B01F 15/02

[52] U.S. Cl. ..... 494/14; 494/41; 277/74; 277/75; 277/81 R

[58] Field of Search ..... 494/13, 14, 38, 39, 494/40, 41, 27, 28, 29, 30, 85; 277/74, 75, 81 R, 27, 83

[56] References Cited

U.S. PATENT DOCUMENTS

| | | | |
|---|---|---|---|
| 1,100,872 | 6/1914 | Hall | 494/41 |
| 2,651,455 | 9/1953 | Strezynski | 494/41 |
| 2,662,687 | 12/1953 | Spross | 494/41 |
| 3,126,338 | 3/1964 | Steinacker | 494/41 |
| 3,561,773 | 2/1971 | Baumann et al. | 277/83 X |
| 4,017,023 | 4/1977 | Hemfort | 494/41 |
| 4,194,745 | 3/1980 | McDougal | 277/83 X |
| 4,552,368 | 12/1985 | Wallace | 277/27 |
| 4,722,534 | 2/1988 | Wentworth | 277/27 |

*Primary Examiner*—Frankie L. Stinson
*Attorney, Agent, or Firm*—Bucknam and Archer

[57] ABSTRACT

The liquid being handled is introduced through a centrifugal conduit 1, is separated according to the different density and the two liquid phases exit through conduits 4 and 5. The centrifugal separator comprises disks for sealing (6, 11 and 19) which are fixed respectively to the central part of the rotor 7 to the middle disk 12 and to the upper cover 20 of the apparatus against which the moveable shaped rings (8, 13, 14 and 17) press. The movable rings are subjected to the pressure of the liquid being introduced into the separator as well as the pressure of the two liquid phases being separated by centrifugation due to the difference in specific weight. In this manner, a perfect seal between the different phases is ensured, no biasing means are needed and there is no necessity of particular external cooling.

6 Claims, 1 Drawing Sheet

CENTRIFUGAL SEPARATOR WITH ROTATING SEALS ON THE FIXED UPPER HEAD

Figure 1:
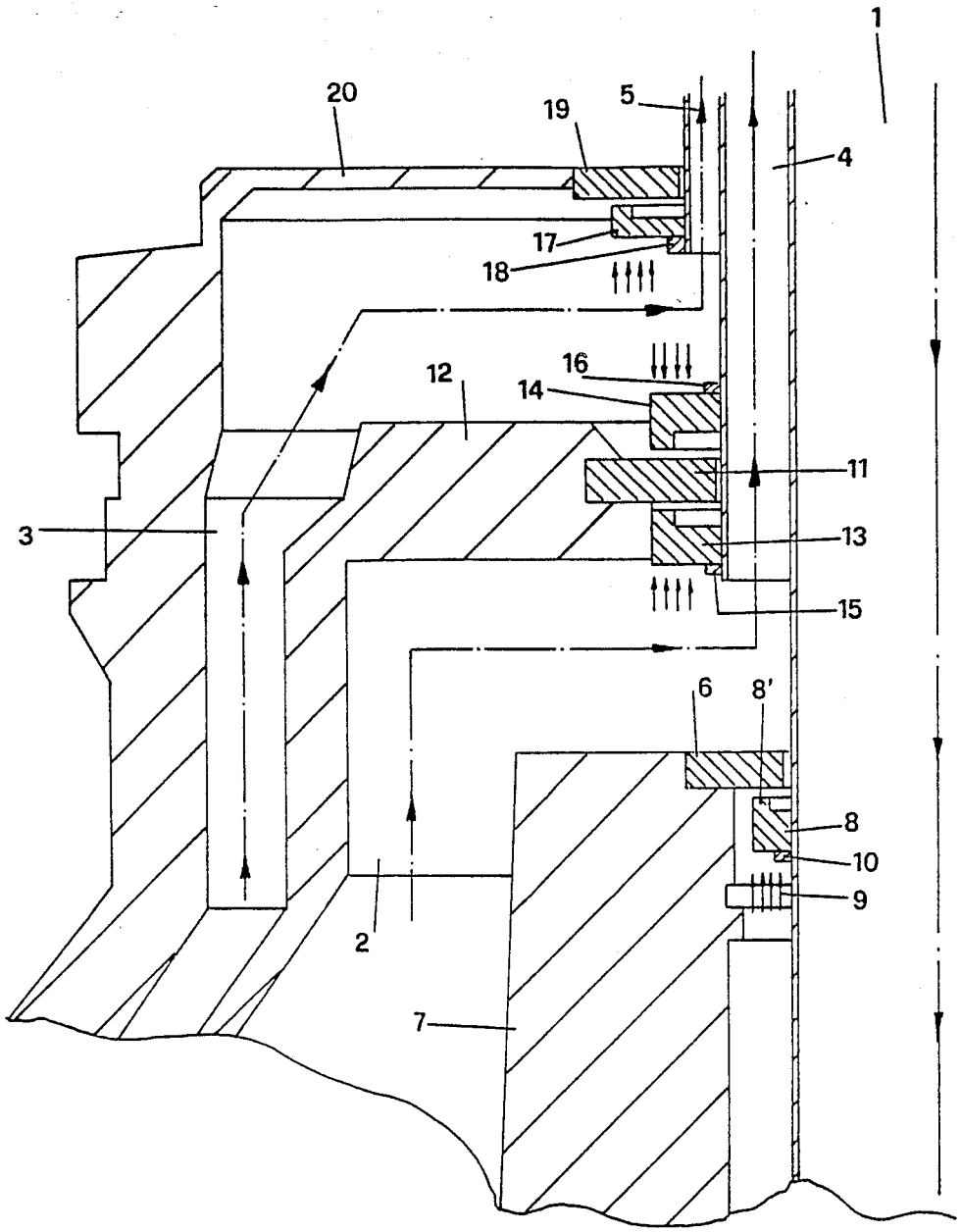

This application is a continuation-in-part of Ser. No. 116,524 filed on Nov. 3, 1987 and now U.S. Pat. No. 4,810,240.

The present invention relates to centrifugal separators for liquids and is particularly intended for use in the milk industry but may also be used for mineral oils, vegetable oils or other liquid mixtures in which, due to the centrifugal force, the liquids are separated in their different components which have different density.

A centrifugal separator of this type is described in Italian Application No. 85.629/A86 assigned to the same assignee filed on Nov. 5, 1986 and the corresponding U.S. application Ser. No. 116,524 filed Nov. 3, 1987, the subject matter of which is incorporated herein by reference.

The earlier application provides that the liquids having different density are separated under the action of the centrifugal force of the apparatus by being caused to ascend within annular concentric conduits formed in the rotating part of the apparatus and then being distributed through conduits formed in the fixed head of the apparatus for the various destinations.

The hermetic seals between the rotating part of the apparatus and the fixed head are ensured in the earlier application by means of moveable rings which rotate together with the rotating part of the apparatus, the rings coming in contact with other rings fixed resiliently to the fixed upper part of the apparatus, a fact which eliminates any possibility of contact of the various liquid phases with the atmosphere. Suitable conduits are provided for letting cooling water under pressure flow through for the purpose of cooling both the fixed rings as well as the rotating rings which guarantee the seal.

The seal between the moveable rings and the fixed rings is ensured in the apparatus according to the earlier application by suitable springs which act on rings which do not rotate because they are disposed on the fixed part of the apparatus but are subjected to the action of the compression springs which push the rings downwardly. Therefore, the rings which do not rotate are compelled to remain in contact with the moveable rings located in the rotating part of the apparatus, thus avoiding that the liquids separated due to the centrifugal force mix again among themselves.

This solution gives rise, however, to some drawbacks due mainly to the complexity of the hydraulic circuits involved in the separation of the liquids as well as the presence of the compression springs which involve very vulnerable structures, which require continuous control and require frequent replacement as the result also of the properties of the liquids being used.

An object of the present invention is to improve the centrifugal separator of the earlier application and to eliminate the drawbacks mentioned hereinabove.

In the present invention the fixed head of the apparatus is substantially simplified and the seals between the several axial conduits are ensured by shaped rings which are moveable with respect to the fixed parts of the apparatus. These movable rings come in contact with rings which are fixed with respect to the rotating parts of the apparatus because of the pressure of the liquids which acts on the moveable rings, thus obtaining substantial simplification of the hydraulic circuits of the apparatus and permitting above all to eliminate every type of elastic spring, thus simplifying the operation and the maintenance of the apparatus.

In particular the displacement of the rings involved in the seal causes that they are lapped directly by the components of the liquids in the apparatus, a fact which causes absorption of the heat produces in the motion of the rings, thus eliminating the necessity of providing cooling of the liquids by means of water circulation as provided in the earlier application.

The invention will be explained in more detail hereinbelow by reference to the drawing in which:

FIG. 1 is a view of the upper part of the centrifugal separator partially axially in cross-section with the rotating seals according to the present invention.

As shown in FIG. 1, the liquid being handled is introduced into the centrifugal separator through the central conduit 1 and exits after having been separated in the two phases of different specific weight through the coaxial conduits 2 and 3. In particular the phase of lower specific weight which ascends through the coaxial more internal conduit 2 is brought to the coaxial conduit 4 which is disposed in the fixed head of the apparatus at the outlets while the phase with greater specific weight which ascends from the external coaxial conduit 3 exits through the exit outlet 5 which is disposed in the fixed part of the apparatus. The arrows shown in the figure designate the course performed by the different liquid phases.

The seal between the central inlet conduit 1 and the first coaxial exit conduit 2 is ensured by the ring 6 which is fixed to the central part 7 of the rotor. The moveable ring 8 comes in contact with central part 7 of the rotor. The moveable ring 8 is located coaxially with respect to the central tube 1 and comes in contact with its upper lip 8 with the fixed ring 6, under the thrust action of the pressure of the liquid present in conduit 1, which pressure is exerted along the direction of the arrow 9.

The stop element 10 is fixed to the central conduit 1 but limits the opening motion of the moveable ring 8.

Analogously, the seal between the liquids of the coaxial conduits 2 and 3 is ensured by the fixed ring 11 which is fixed to the disk 12, the latter closing in the upper part the conduit 2 and the two rings 13 and 14. The motion of the rings 13 and 14 is limited by the stop elements 15 and 16 which are fixed to conduit 4. The two rings, 13 and 14, are subjected respectively to the pressure of the liquid of the light phase which comes from conduit 2 and to the presure of the liquid of the heavy phase which comes from conduit 3.

Analogously, the external seal is ensured by the moveable ring 17 which is coaxial with the external conduit 5 and which is limited in its motion by the stop element 18, the latter being fixed to the external wall of conduit 5. The external seal is also ensured by the fixed ring 19 which is fixed to the head 20 of the apparatus.

The advantages resulting from the present invention and specifically the head of the centrifugal separator for the liquids with rotating seals with respect to the head of the earlier centrifugal separator described in the Italian Application No. 85.629/A86 and the corresponding U.S. application Ser. No. 116,524 are clear not only with respect to the substantial simplification in the construction of the apparatus but also above all because of the elimination of elastic elements and specifically springs because the seal between the moveable rings and the fixed rings is ensured by the same pressure exerted by the liquid on the same moveable rings.

It should also be stressed that there is a substantial advantage resulting by the cooling performed by the same liquids on the rings, without the necessity of providing for the cooling by means of cirulation of cold water under pressure.

Obviously, the apparatus has been described and illustrated in the drawing attached hereto according to one specific embodiment which, however, has been described only by way of a non-limiting example because the particular constructional details may be varied in form and different aspects, while the essential characteristics of the invention remain unchanged.

What is claimed is:

1. In centrifugal separator for the separation of a liquid into severl phases of different density which comprises a fixed upper head (20), a rotating body (7) having a central part, an inlet conduit (1) for said liquid into said rotating body, concentric conduit means (2 and 3) for the different phases of differnet density, the liquid of lower density ascending through the more internal conduit (2), the liquid of greater density ascending through the external conduit (3), said conduit (2) communicating with coaxial outlet conduit (4) disposed in said fixed head, said conduit (3) communicating with outlet (5) disposed in said fixed head, the improvement which comprises a ring (6) fixed to said central part of the rotating body, movable rings (8, 13, 14 and 17) suitably shaped and capable of displacement, said ring (8) being capable of displacing with respect to the central conduit (1), said ring (8) being located coaxially with respect to said inlet conduit (1) and under the thrust of the pressure of the liquid in said inlet conduit (1) coming in contact with said fixed ring (6) and providing a seal between said inlet conduit (1) and said internal conduit (2), a fixed disk (12) located in the uppper part of said conduit (2), said rings (13 and 14) being capable of displacement with respect to the outlet coaxial conduit (4) and being subject to the pressure of the liquid of lower density from said conduit (2) and to the pressure of liquid of greater density from said conduit (3) and providing a seal between the liquids in the conduit (2) and conduit (3), said ring (17) being external and being coaxial with said outlet conduit (5), said ring (17) being capable of displacement along the external conduits (5) and providing an extenal seal, said movable rings ensuring hermetic seals and ensuring a perfect separation between the various phases without requiring return springs.

2. A centrifugal separator according to claim 1 wherein the rings are lapped by the liquids whereby they are cooled.

3. The separator according to claim 1 wherein a stop element (10) fixed to said inlet conduit (1) limits the motion of said movable ring (8).

4. The separator according to claim 1 wherein stop elements (15 and 16) fixed to said conduit (4) limit the motion of said rings (13) and (14).

5. The separator according to claim 1 wherein said conduit (5) has external wall and a stop element (18) fixed to the external wall of said conduit (5) limits the motion of said ring (17).

6. The separator according to claim 5 wherein a fixed ring (19) fixed to said upper head (20) ensures external seal.

* * * * *